US012576328B2

(12) United States Patent
Goverud-Holm et al.

(10) Patent No.: US 12,576,328 B2
(45) Date of Patent: Mar. 17, 2026

(54) PART OF A BINDING SYSTEM

(71) Applicant: ROTTEFELLA AS, Lierstranda (NO)

(72) Inventors: Thomas Goverud-Holm, Hof (NO); Magnus Anderssen, Nesodden (NO); Øyvar Svendsen, Oslo (NO); Jørn Frode Danielsen, Drøbak (NO); David Klovning Flem, Slependen (NO); Edward Jones, Lommedalen (NO)

(73) Assignee: ROTTEFELLA AS, Lierstranda (NO)

( * ) Notice: Subject to any disclaimer, the term of this patent is extended or adjusted under 35 U.S.C. 154(b) by 145 days.

(21) Appl. No.: 18/271,149

(22) PCT Filed: Jan. 7, 2022

(86) PCT No.: PCT/NO2022/050003
§ 371 (c)(1),
(2) Date: Jul. 6, 2023

(87) PCT Pub. No.: WO2022/149985
PCT Pub. Date: Jul. 14, 2022

(65) Prior Publication Data

US 2024/0075376 A1 Mar. 7, 2024

(30) Foreign Application Priority Data

Jan. 8, 2021 (NO) ..... 20210026

(51) Int. Cl.
*A63C 9/20* (2012.01)

(52) U.S. Cl.
CPC ..... *A63C 9/20* (2013.01)

(58) Field of Classification Search
CPC ... A43B 5/0411; A43B 5/0413; A43B 5/0496; A43B 5/0423; A43B 5/0403;
(Continued)

(56) References Cited

U.S. PATENT DOCUMENTS 899,698 A 9/1908 Mclean
1,385,239 A * 7/1921 Babbitt ..... G10D 7/08
84/383 R
(Continued)

FOREIGN PATENT DOCUMENTS

CN 1178371 A 4/1998
CN 201141208 Y * 10/2008
(Continued)

OTHER PUBLICATIONS

DE-3141425-C Translation (Year: 1982).*
(Continued)

*Primary Examiner* — Michael T. Walsh
(74) *Attorney, Agent, or Firm* — Harness, Dickey & Pierce, P.L.C.

(57) ABSTRACT

The present invention relates to a part of a skiing binding system, comprising a housing with, on the inside, a fully or partially through-going bore with an inner diameter, coaxial with a barrel arranged in a direction transverse to a longitudinal axis of a ski, wherein two pins, each moveable transverse to a longitudinal axis of the ski in a first direction and second direction with at least one intermediate spring element are arranged, and wherein the pins are adapted to slide in the barrel between a protruding and a retracted position. According to an aspect of the invention, the part of the pins that is exposed when the pins are in the protruding position, has a reduced outer diameter compared with the inner diameter of the barrel. The invention also relates to a method for lubricating the pins with a lubricant.

16 Claims, 12 Drawing Sheets

Figure 1A:
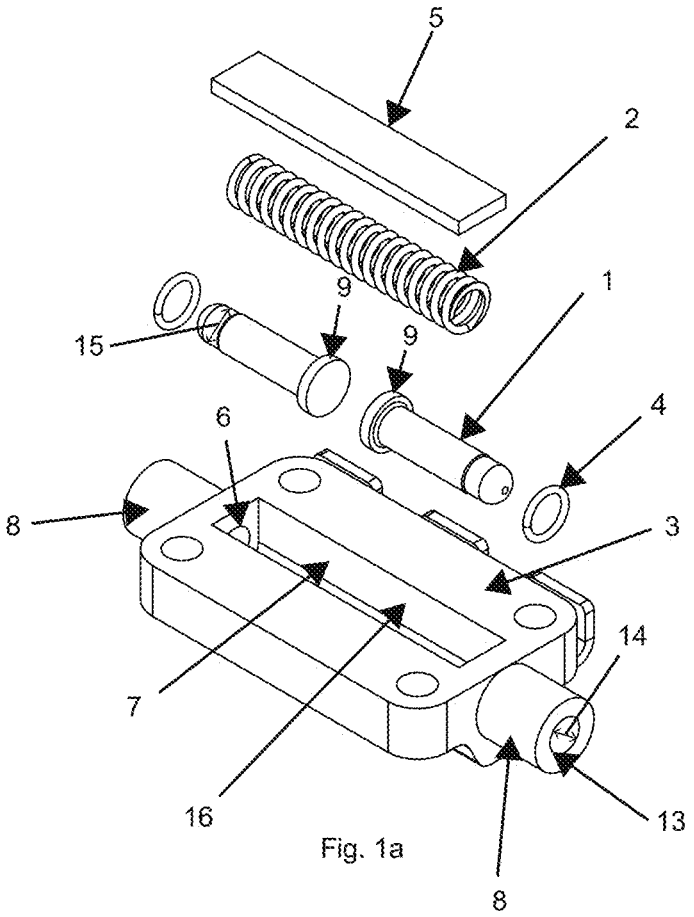

(58) Field of Classification Search
CPC ..... A43B 21/47; A63C 9/20; A63C 9/0807; A63C 9/08585; A63C 9/086; A63C 9/08592; A63C 9/08; A63C 9/22
See application file for complete search history.

(56) References Cited

U.S. PATENT DOCUMENTS

| | | | | | |
|---|---|---|---|---|---|
| 3,693,989 | A * | 9/1972 | Forcht | A63C 9/007 280/628 |
| 3,905,613 | A * | 9/1975 | Romeo | A63C 9/0846 280/623 |
| 4,023,824 | A * | 5/1977 | von Besser | A63C 9/086 280/623 |
| 5,697,631 | A * | 12/1997 | Ratzek | A63C 10/08 280/613 |
| 6,378,658 | B1 * | 4/2002 | Kay | F16D 65/00 188/264 B |
| 9,816,519 | B2 * | 11/2017 | Nowitzki | F04D 13/10 |
| 2015/0335987 | A1 * | 11/2015 | Nobile | A63C 9/22 280/615 |
| 2015/0368928 | A1 * | 12/2015 | Ulrich | E05C 19/06 70/344 |
| 2019/0240560 | A1 * | 8/2019 | Svendsen | A63C 9/086 |

FOREIGN PATENT DOCUMENTS

| | | | | | |
|---|---|---|---|---|---|
| CN | 205419057 | U | * | 8/2016 | |
| DE | 3141425 | C | * | 11/1982 | |
| DE | 3141425 | C1 | | 11/1982 | |
| EP | 0551899 | B1 | | 6/1996 | |
| EP | 1845815 | A1 | | 10/2007 | |
| EP | 2946818 | A1 | | 11/2015 | |
| EP | 2116286 | B1 | | 3/2016 | |
| KR | 200454583 | Y1 | * | 7/2011 | E02F 3/382 |
| NO | 20190775 | A1 | | 12/2020 | |
| NO | 20210539 | A1 | * | 10/2022 | A63C 9/086 |
| RU | 1829947 | A3 | | 7/1993 | |
| RU | 2696949 | C9 | * | 9/2019 | F42B 10/00 |
| WO | 2018004355 | A1 | | 1/2018 | |
| WO | WO-2022149986 | A1 | * | 7/2022 | A63C 9/08592 |

OTHER PUBLICATIONS

CN-201141208-Y Translation (Year: 2008).*
RU-2696949-C9 English Translation (Year: 2019).*
DE-3141425-C English Translation (Year: 1982).*
CN-205419057-U English Translation (Year: 2016).*
KR-200454583-Y1 English Translation (Year: 2011).*
WO-2022149986-A1 English Translation (Year: 2022).*
NO-20210539-A1 English Translation (Year: 2022).*
Extended European Search Report for application No. 22736952.7 dated Oct. 25, 2024.
International Search Report and Written Opinion of the ISA issued in PCT/NO2022/050003, mailed Mar. 10, 2022; ISA/XN.
Norwegian Search Report issued in Norwegian Application No. 20210026, date of report: Aug. 8, 2021.
Norwegian Search Report issued in Norwegian Application No. 20210026 issued on Mar. 21, 2025.
Russian Search Report for application No. 2023120472 filed Apr. 29, 2025.
European Office Action for Application No. 22 736 952.7 issued on Oct. 23, 2025.

* cited by examiner

Detail I

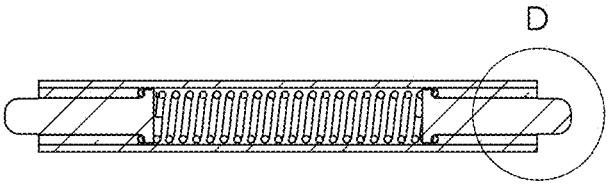
Fig. 4a
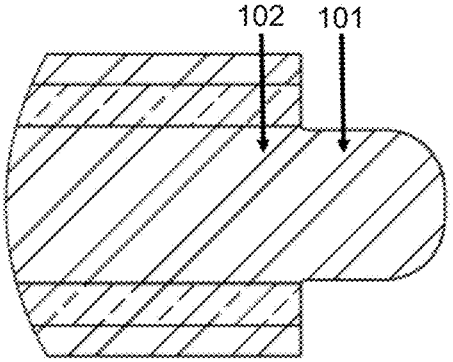
Detail D
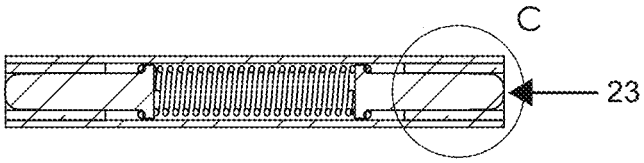
Fig. 4b
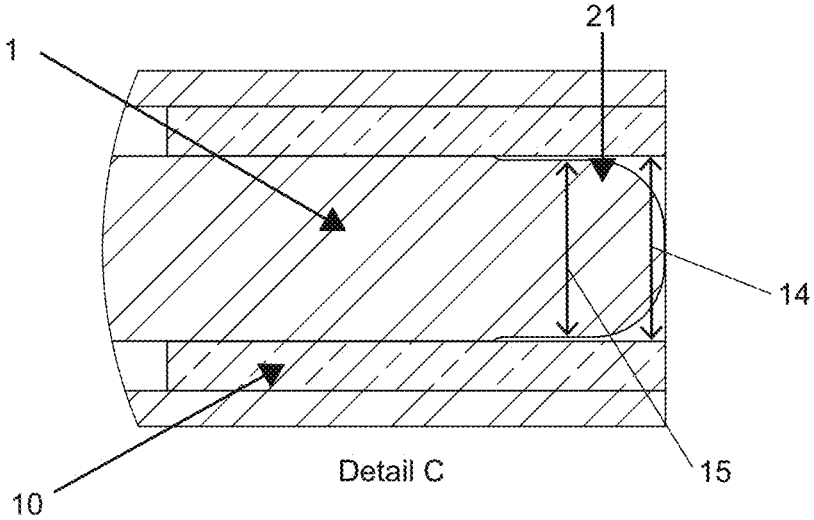
Detail C

Detail N

PART OF A BINDING SYSTEM

CROSS-REFERENCE TO RELATED APPLICATIONS

This application is a 371 U.S. National Phase of International Application No. PCT/NO2022/050003, filed Jan. 7, 2022, which claims priority to Norwegian patent application No. 20210026, filed Jan. 8, 2021. The entire disclosures of the above applications are incorporated herein by reference.

The present invention relates to a part of a binding system for skiing, more specifically a binding system for cross-country skiing, backcountry skiing or randonee as indicated in the preamble of claim 1.

BACKGROUND

EP1845815A1, EP0551899B1 and EP2116286B1 show various aspects and embodiments of the cross-country and mountain ski bindings that are common today. These binding systems comprise pins arranged transverse to the longitudinal axis of a ski arranged in or close to the tip of a skiing shoe, between two longitudinal sole elements. This pin can be disposed in a pin-accommodating, transverse barrel in a binding of a ski, some form of mechanically tilting, rotating or displaceable gripping or holding mechanism keeping the pin in place in said barrel. Furthermore, these conventional binding systems comprise various types of flexor elements, levers, angles and material properties that give the binding system increased ease of operation, skiing feeling, stiffness/softness, durability etc. Although this type of binding functions very well, it is clear that most of the potential for improvement has been taken out of the systems given the physical and dimensional limitations, e.g. the width and thickness of the pins.

Figure 3A:
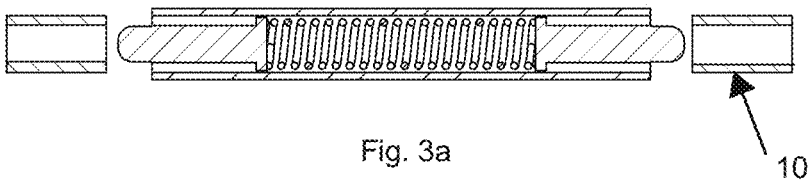
Figure 3B:
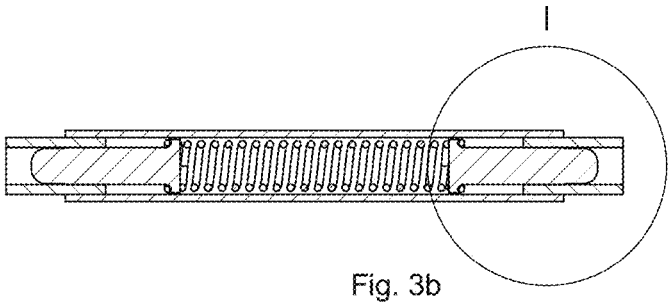
Figure 3C:
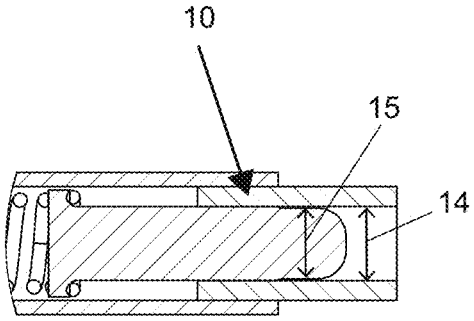
Figure 3C:
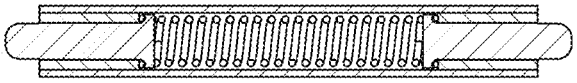
Figure 4C:
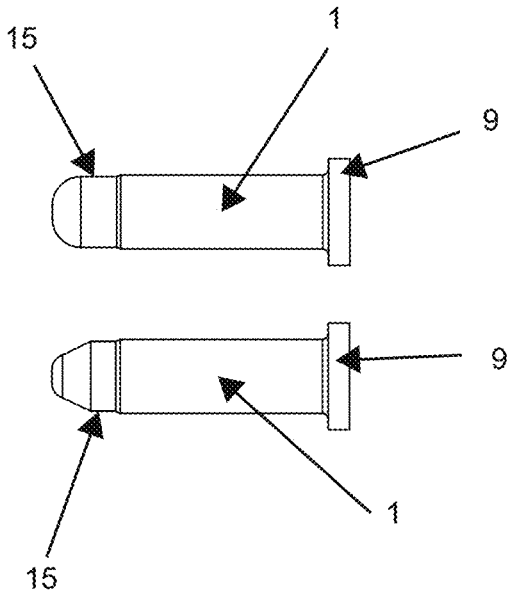

EP2946818B1 shows a binding system comprising two protruding, transverse pins or pegs, which are spring-biased and can be snapped into a bracket or the like mounted on a ski, see particularly FIGS. 3 to 4c. Though EP2946818B1 primarily relates to a binding system intended for randonnee, there are aspects of the solution that can be beneficial for cross-country and backcountry skiing. The solution may i.a. give more torsion-stiff solutions, as the width of the attachment points is increased. Otherwise EP2946818B1 relates to solutions of compressing the pins when a ski boot is to be released from the bracket mounted on the ski. For instance, a solution is proposed comprising a button and bushing system, which is mounted in the holes in the bracket, into which the pins fit. The pins are indirectly pressed out of the holes by pushing the buttons.

Moreover, there are other examples of binding systems comprising protruding, spring-biased, displaceable pins, e.g. DE3141425A from 1981 and CN1178371 A from 1971, but these are intended for a releasable snowboard binding, alpine bindings or other applications.

None of the solutions mentioned above, in so far as they are relevant relative to the present invention, mentions how the moveable protruding pins can be arranged in practice, so that they function as intended over time.

The pins will be located on a ski shoe, where they will be stored and spring-biased in an completely or partially closed housing. The ski shoes are intended to be used under varying temperature and moisture conditions, ranging from strong cold to above-zero temperatures as well as anything from cold, dry air to slush and surface water. The shoes and the protruding pins will also be exposed to gravel, sand, asphalt as well as blows and scratches. Furthermore, it must be expected that the shoe will be unused for large parts of the year, e.g. in a booth, a cabin or stowed away in a cupboard. The housing, springs and pins will be exposed to condensation, large variations in temperature and mechanical wearing, which could quickly cause the pins to get stuck due to corrosion or mechanical scratches or wounds.

Therefore, it is an object of the present invention to provide a binding system comprising transverse, protruding, displaceable pins that can withstand the use for which it is intended. It is also an object to provide such as system that is simple to manufacture, simple to maintain, simple in terms of replacement of parts, which will function after a long time without being in use, and/or which will function even though it is worn.

BRIEF COMMENTS ON THE DRAWINGS

Figure 1B:
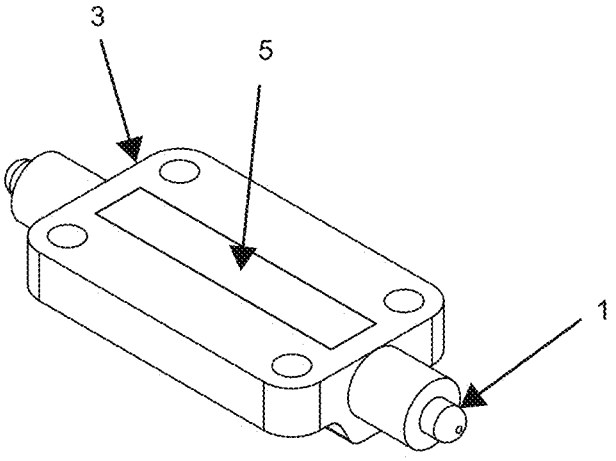
Figure 2A:
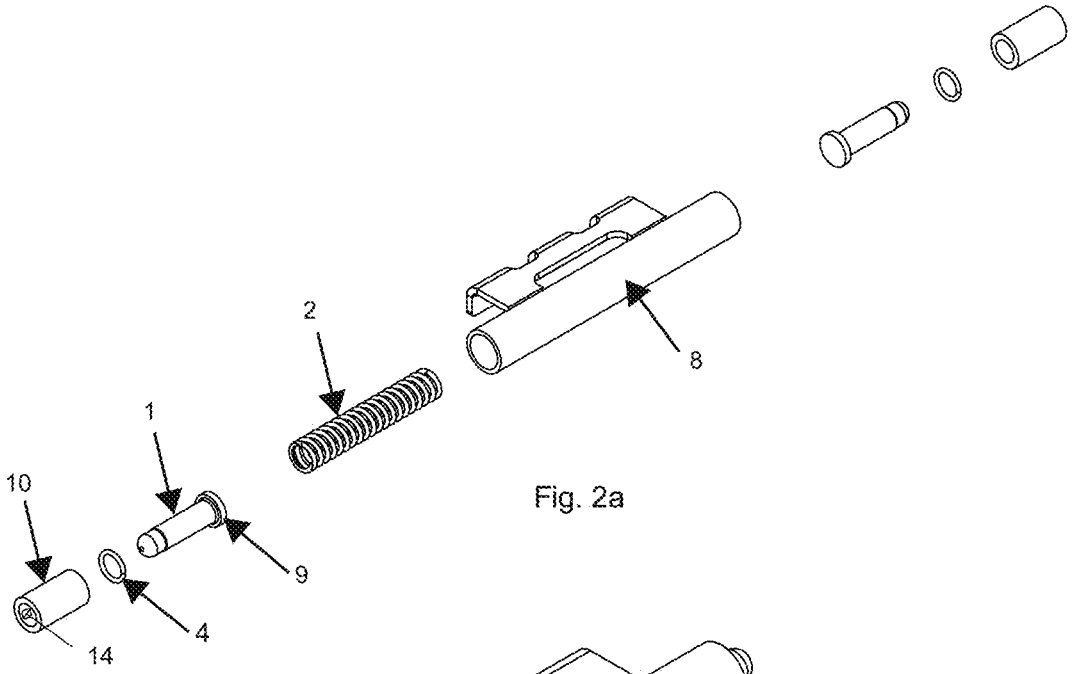
Figure 2B:
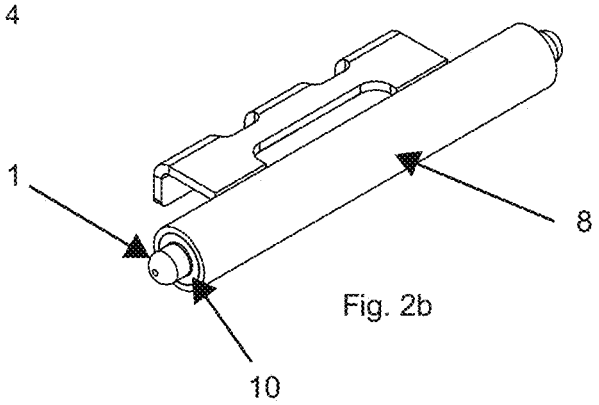
Figure 2C:
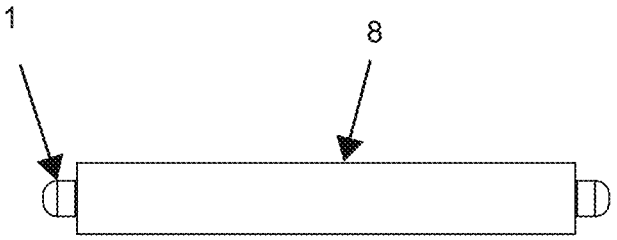
Figure 2D:
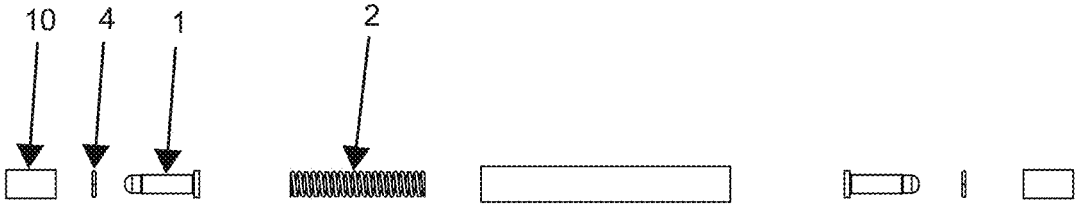
Figure 5A:
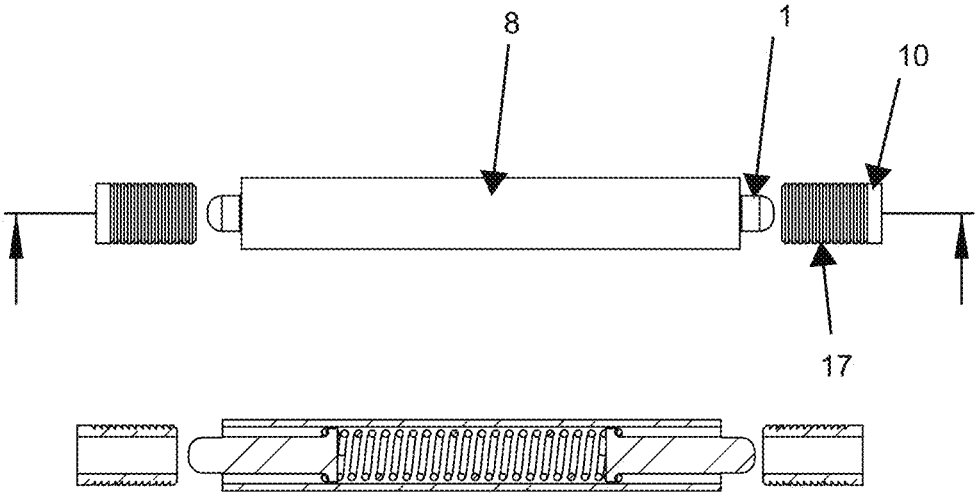
Figure 5B:
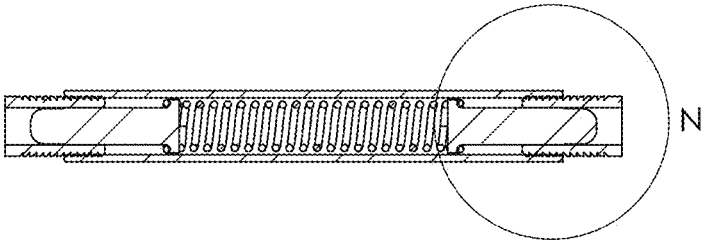
Figure 5C:
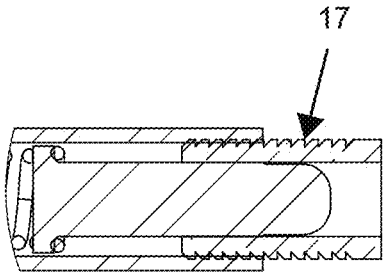
Figure 5C:
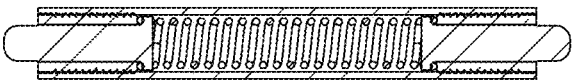
Figure 6A:
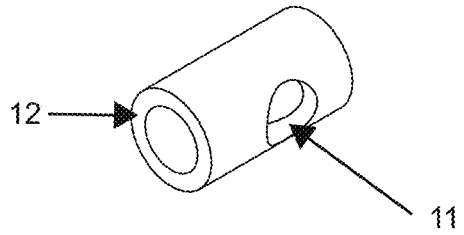
Figure 6B:
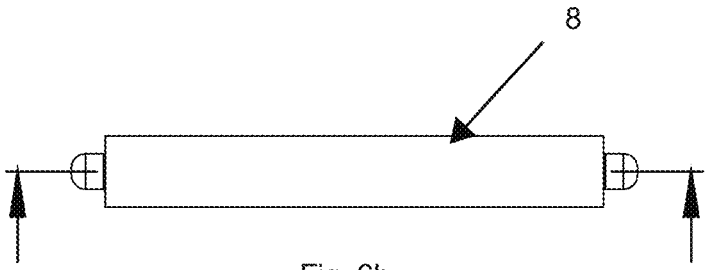
Figure 6C:
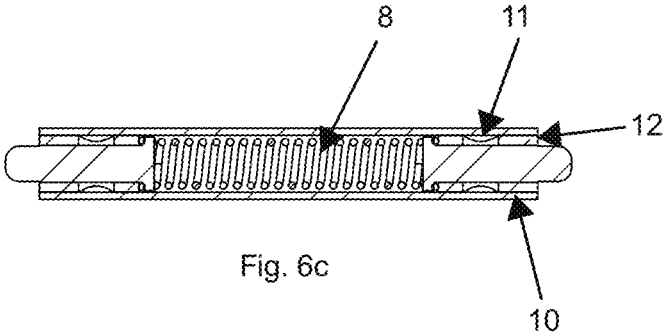
Figure 7A:
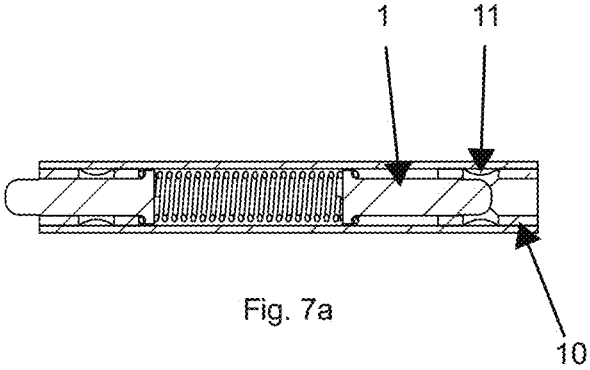
Figure 7B:
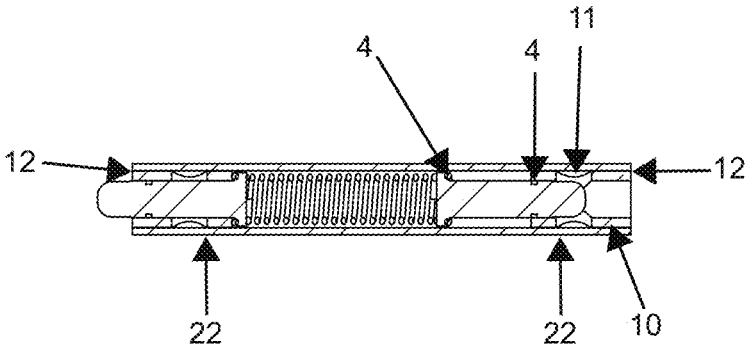
Figure 7C:
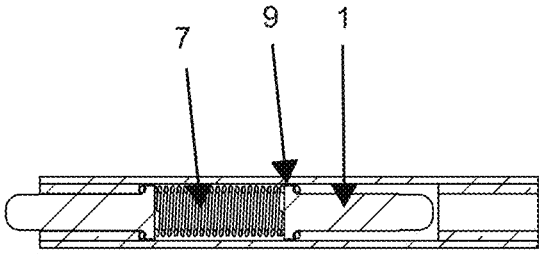

The above-mentioned objects, in addition to further objects, characteristics and advantages of the present invention, will also to a larger extent be understood by means of the following illustrative and non-limiting description and with reference to the accompanying figures of a possible embodiment of the invention, wherein FIGS. 1*a-b* show a possible embodiment of the system according to the invention, FIGS. 2*a*-2*d* show an alternative embodiment according to the invention, FIGS. 3*a-c* show a longitudinal view through and a detail of how an embodiment according to the invention can be assembled, FIGS. 4*a-b* show the embodiment of FIGS. 3*a-b* in protruding and retracted positions, respectively, FIG. 4*c* shows various embodiments of the pin, FIGS. 5*a-c* show a longitudinal view through and a detail of how another embodiment according to the invention can be assembled, FIGS. 6*a-c* show a possible embodiment of a grease storage, FIGS. 7*a-c* show a couple of embodiments and mode of applications of the embodiment in FIGS. 6*a-c,*

FIGS. 8*a-d* show a method for disassembling the embodiment shown in FIGS. 3*a-c,*

FIGS. 9*a-d* show a method for distributing lubricant on the inside of the part, and FIGS. 10*a*-10*f* show a method for spraying lubricant into the part.

DETAILED DESCRIPTION

FIGS. 1*a* and *b* show a first embodiment of the present invention. FIG. 1*a* is an expanded figure comprising two pins 1, at least one spring element 2, a housing 3, a barrel 13, gaskets 4 and a lid 5. The pins 1 have a base 9 with a larger diameter. FIG. 1*b* shows the embodiment in the assembled state. The gaskets 4 are pulled onto the pins 1 before the pins 1 are guided down into a cavity 7 in the housing 3 and further through holes 6 in the tubes 8. Subsequently, the spring element 2 is inserted between the pins 1. Grease or another lubricant is filled into the cavity 7 before it is closed by means of the lid 5. The cassette 3 can be moulded into or screwed into the front part of a shoe sole (not shown). The pins 1 protrude to each side and are compressed by means of a clamping force that overcomes the spring force to the spring 2 and the friction in the system. The clamping force can be generated by the cassette 3 and the pins 1 being guided down in to a complementary part of the binding system, e.g. a bow or bracket with pin-receiving holes, by the pins 1 being compressed with the hands or by means of a clamp or release mechanism in the binding system.

FIGS. 2*a-d* show an alternative embodiment of the invention. Instead of a cassette 3, the embodiment comprises a tube element 8, wherein the barrel 13 through which the pins 1 travel, consists of bushings 10 that are pressed into the housing. The pins 1 are pulled through the gaskets 4 and subsequently through bushings 10. The outer diameter of the bushings 10 and the inner diameter of the tube element 8 as well as choice of material are so that a press fit arises. It is important that the inner dimension of the bushing 10 does not shrink, so that the pin 1 does not become wedged or drags. At the same time, the tube 8 may not crack. It is quite acceptable that the tube expands somewhat. In this embodiment, a small amount of grease is packed into the spring 2 and the tube 8 before the bushings 10 are pressed into the tube 8. During use of the binding system, the grease will pass around the base 9 and to a certain extent lubricate the surfaces that are in contact between the outside of the pin 1 and the inside of the bushings 10.

FIGS. 3*a-c* show a sequence, both in perspective and as a sectional view, of an assembly of the parts, the bushings 10 being gradually pressed into the tube 8, forming a press fit.

FIGS. 4*a-c* show the further embodiment of FIGS. 3*a-b* in protruding and retracted positions, respectively.

The invention targets a problem that may arise during use: wearing, indents, corrosion etc. may cause the surface of the pin 1 to be become rough/scratched and may get stuck in the bushing 10. According to the present invention, this is solved by giving the pin 1 varying diameters, more specifically by the diameter of the pin that is exposed when the pin 1 is in the extreme position (position in use) is smaller than an inner diameter of the bushing. FIG. 4*a* shows the pin in the extreme position, and FIG. Detail D shows a first part 101 of the pin and a second part 102 of the pin. FIG. 4*b* shows the pin 1 in an inner, retracted position 23, where it can be seen that there is a clearance between the head end of the pin 1 and the inside of the bushing 10. FIG. 4*c* shows two possible configurations of such tapering head end. It should be understood that other configurations are also possible. FIG. 4*c* also shows the differences in an outer diameter 15 the pin 1 and an inner diameter 14 of the bushing 10. The part of the pin that has a reduced diameter 15 is the part of the pin that constitutes the bearing surface, and it should be essentially straight. The head end 21 outside the bearing surface with diameter 15 can have different curvatures tapering in other ways, e.g. can be wholly or partially frustoconical. The width of the bearing surface and the configuration of the head end 21 can be of importance to the release from the binding. The release will typically take place by the pins 1 individually or synchronously being compressed into the housing/tube/bushing. During this compression, the slip between the diameter 15 of the pin 1 and the inside of the bushing 10 leads to the bushing 10 being spared for unnecessary wear. The configuration of the head end 21 can contribute to facilitating the release of the shoe from the binding on the ski, because the head end 21 gives further clearance between the pin 1 and the holes/openings in the binding part on the ski. This may facilitate that the shoe is more easily disengaged from the holes/openings of the binding part on the ski.

FIGS. 5*a-c* show an alternative embodiment of the invention as well as a sequence, both in perspective and as a sectional view, of an assembly of the parts, the bushings 10 being gradually pressed into the tube 8 and forming a press fit. In this embodiment, the bushings are 10 grooved on the outside. When the bushings 10 are pressed into the tube 8, the top of the grooves are scraped or deformed, so that the outer diameter is reduced. With this, a (more than) sufficient pressure against the tube is obtained without the inner diameter of the bushing 10 being reduced or a risk that the tube cracks. This embodiment allows the tolerance of the tube 8 to be looser, as the outer diameter of the bushings 10 can be slightly larger than the inner diameter of the tube. One of the advantages of this is that the end product becomes cheaper, and that there is more flexibility and room for maneuver as regards the quality of the raw materials, change of sub-supplier, adjustments underway in the production etc.

FIGS. 6*a-c* show an embodiment of the invention, where it is sought to address the problem that the grease used for lubricating and to a certain extent sealing the slide face between the outside of the pin 1 and the inside of the bushing 10 over time could disappear or dry out. As mentioned above, grease can be added to the spring 2 before or during assembly, as tiny amounts of the grease will pass the base 9 and lubricate said slide faces. The sealing function is also important as ingress of moisture in the system is undesirable. With water encapsulated in the system, varying temperatures and time, rust/corrosion in the system will impair the function of the system. Once the parts have begun to corrode, it will not be easy to repair the parts. According to this embodiment, a pocket, groove(s) or bore is arranged in the bushing 10, the pocket, groove(s) or bore forming a grease storage 11. Thus, more grease will be stored, which will disperse across the pin over a long period of time. It will be possible to use the grease storage 11 formed by the pocket, groove(s) or bore instead of or in addition to grease that may be added to the spring 2. FIG. 6*a* shows an outer edge 12 of the bushing 10, and the grease storage 11 in the bushing 10 is provided at a distance from the outer edge 12 of the bushing 10 in FIG. 6*c*.

FIGS. 7*a-c* show an alternative solution for maintaining and extending the life of the binding system according to the invention. In the solutions shown in the previous figures, including FIGS. 6*a-b*, there is a grease storage, which will be depleted after some time. In addition to the regular consumption of grease to be expected in use, it is also a factor that ski boots for long periods are left unused in cupboards, attics or cabins. After a great deal of use, some mechanical wear of slide and contact faces and perhaps slight ingress of moisture/condensation, a relatively long storage period may cause things to get stuck or function less well. According to this embodiment of the invention, the pins 1 and the system can be configured, so that they also have a valve function for refilling grease. Then grease can either be refilled in the spring chamber or merely on the pin. FIG. 7*a* shows how the pin 1 can be pressed sufficiently in for grease to be refilled in the grease storage 11 in the bushing 10. In this embodiment, the pin 1 can be pushed accurately so far in that the tapered part and/or the rounded head end 21 of the pin 1 forms a small clearance in the grease storage 11 in the bushing 10. In such an embodiment, the clearance between the base 9 must be adequate enough for a lubricant to be pressed past the pin and fill the chamber in which the spring 7 is located.

FIG. 7*b* shows two different possible locations of the gasket 4 on the pin 1, wherein the alternative location of the gasket is so that, during normal use, it will not slide over or past the hole of the bushing 10, forming the grease storage 11. Thus, the grease will always be enclosed within the gasket 4 during normal use, but if the pin 1 is pressed sufficiently far in, so that the gasket 4 slides over or past the hole in the bushing 10 forming the grease storage 11, then the grease storage can be 11 refilled, whereupon the part of the pin located on the inside of the gasket 4 will be lubricated when the pin 1 is let out for normal position in use. It is also possible to have more gaskets 4, e.g. at the base 9 and further out on the pin 1. FIG. 7*b* also shows the outer edge 12 of the bushing 10 and the innermost edge 22 of the grease storage 11.

FIG. 7*c* shows an embodiment without the grease storage 11. The pin 1 is pushed so far in that the grease can be pressed past/around the pin 1 and possibly past the gasket 4 at the base 9 and into the spring chamber 7. In this embodiment, it is also clear that the part of the pin 1, which during ordinary use protrudes from the binding system, has a somewhat smaller diameter than the inner diameter of the bushing 10, the clearance between the pin 1 and the bushing 10 facilitating the passage of the grease past/around the pin 1 when the pin 1 has been pushed sufficiently far in.

FIG. 7*b* shows two different possible locations of the gasket 4 on the pin 1, wherein the alternative location of the gasket is so that, during normal use, it will not slide over or past the hole of the bushing 10, forming the grease storage 11. Thus, the grease will always be enclosed within the gasket 4 during normal use, but if the pin 1 is pressed sufficiently far in, so that the gasket 4 slides over or past the hole in the bushing 10 forming the grease storage 11, then the grease storage can be 11 refilled, whereupon the part of the pin located on the inside of the gasket 4 will be lubricated when the pin 1 is let out for normal position in use. It is also possible to have more gaskets 4, e.g. at the base 9 and further out on the pin 1.

FIG. 7*c* shows an embodiment without the grease storage 11. The pin 11 is pushed so far in that the grease can be pressed past/around the pin 1 and possibly past the gasket 4 at the base 9 and into the spring chamber 7. In this embodiment, it is also clear that the part of the pin 1, which during ordinary use protrudes from the binding system, has a somewhat smaller diameter than the inner diameter of the bushing 10, the clearance between the pin 1 and the bushing 10 facilitating the passage of the grease past/around the pin 1 when the pin 1 has been pushed sufficiently far in.

It appears from the embodiments indicated in FIGS. 7*a-c* that the system can function as a lubricating nipple for maintenance. A complementary grease gun or lubricator 19 can be provided as optional equipment can e.g. be made available in a shop or at a permanent or portable service point. The grease gun or lubricator 19 can comprise a clamp or coupling 20 that matches the binding system, as the pressure from the grease and the lubricator is sufficiently strong to push the pin 1 as far in as to get grease 18 into the system, where desired, or the lubricator 19 moreover comprises a mechanism that pushes in the pin 1 and simultaneously presses in the grease. The grease 18 may have varying viscosity, i.e. be easy-flowing like oil, a quite dry PTFE/TFE-based lubricant or viscous grease.

Figure 9A:
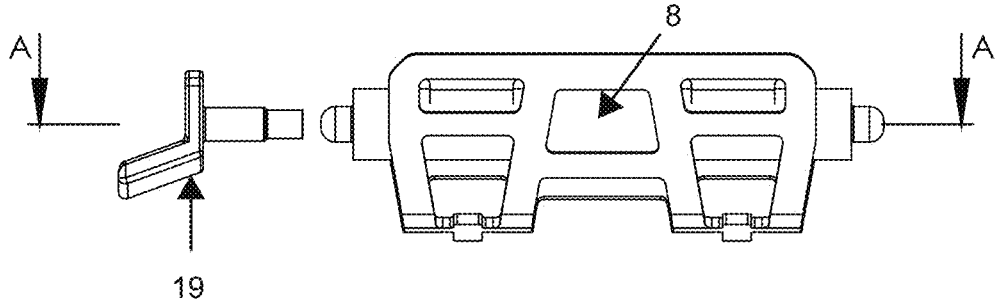
Figure 9B:
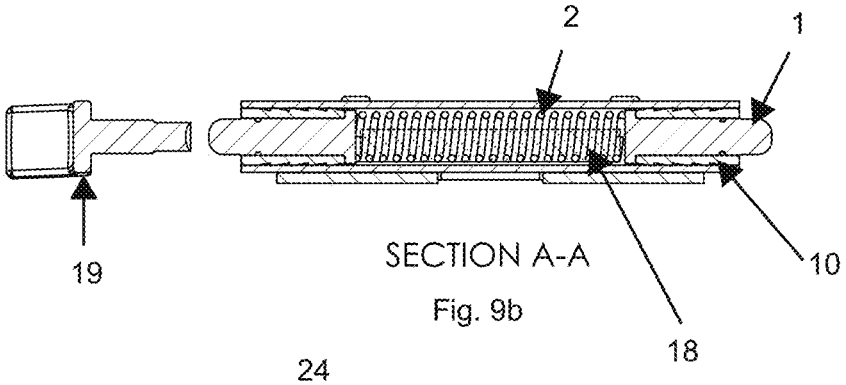
Figure 9C:
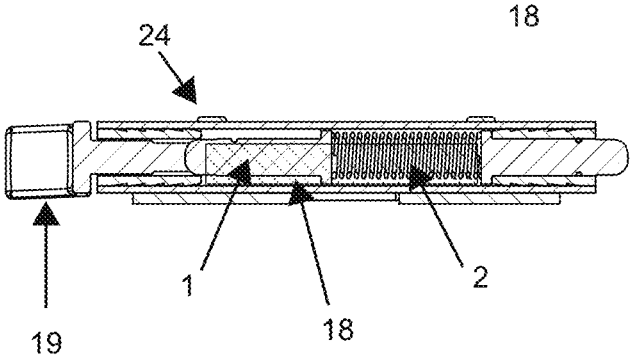
Figure 9D:
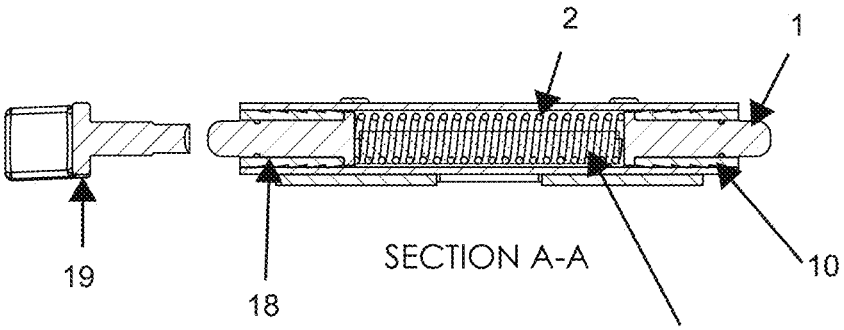

FIGS. 9*a-d* show use of a peg 19. It is configured so that one of the pins 1 can easily be pressed far into the chamber 7, so that the grease 18 located there is compressed and eventually comes past the base 9 of the pin 1 and thereby lubricates the pin 1. Subsequently, this is repeated with the second pin 1. FIG. 9*c* shows the innermost part 24 of the bushing 10.

Figure 10A:
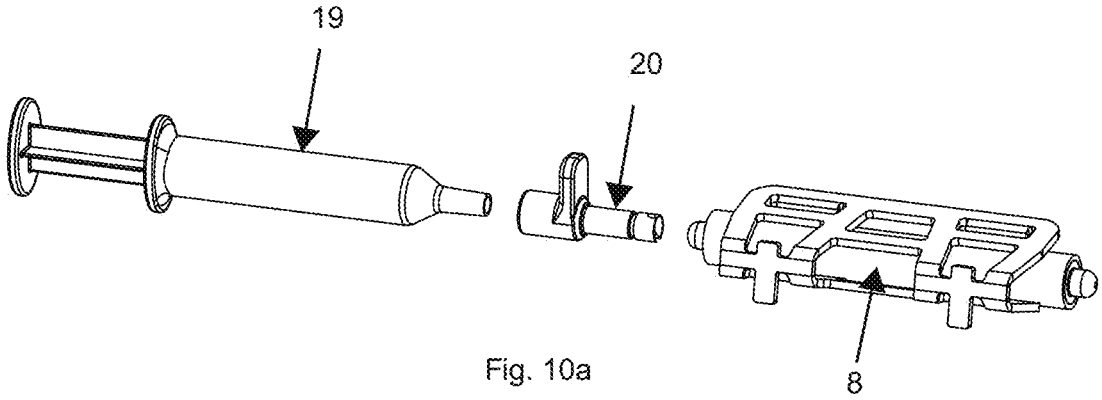
Figure 10B:
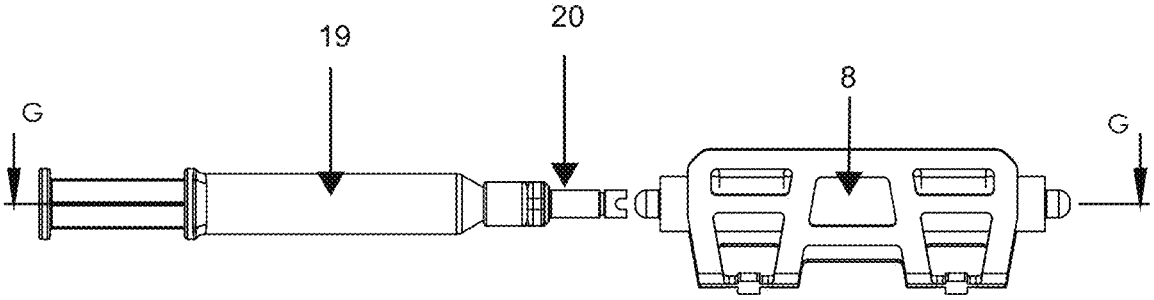
Figure 10C:
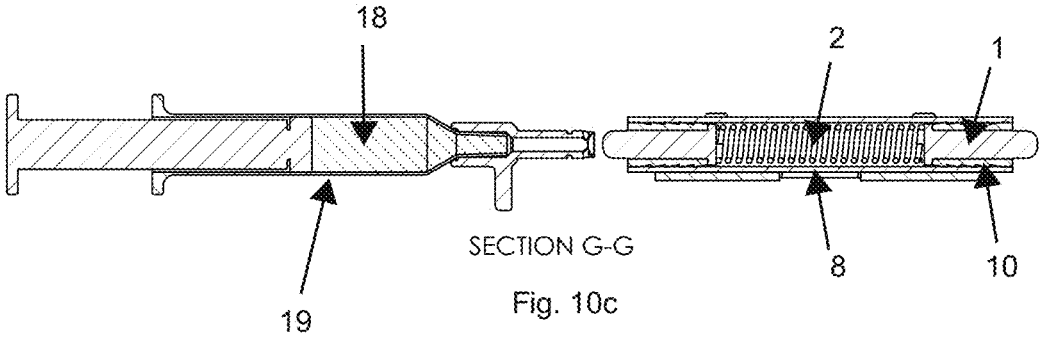
Figure 10D:
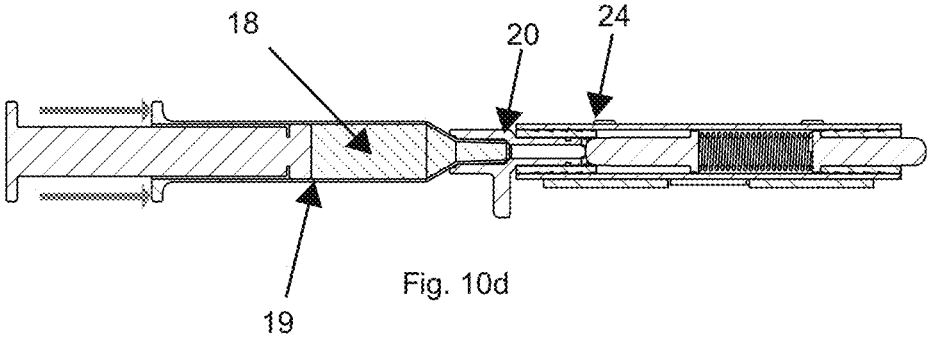
Figure 10E:
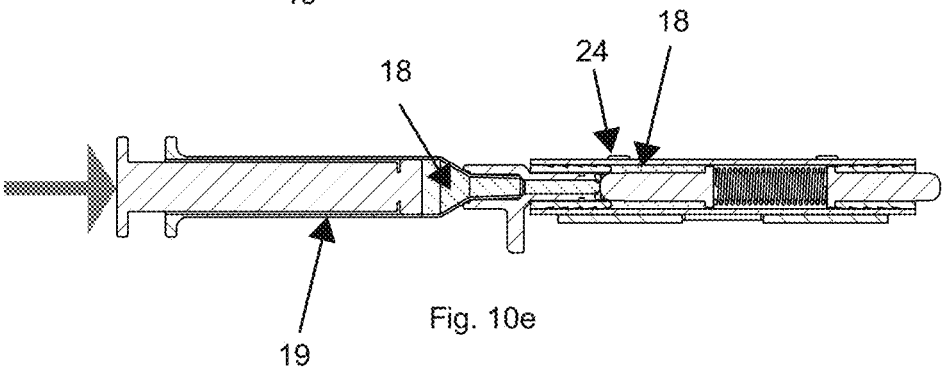
Figure 10F:
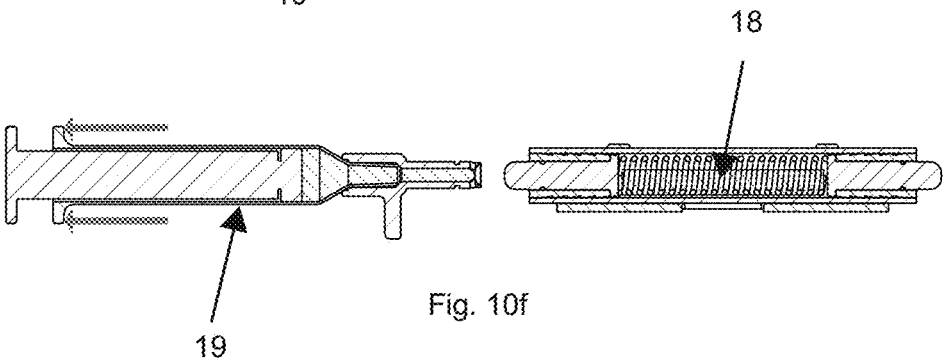

FIGS. 10*a-b* show how a lubricator 20, here in the form of a sprayer, can be used for pressing new grease 18 into the chamber 7 and around the pins 1. The lubricator 19 has a coupling or transition with a configuration that provides room for pressing grease 18 past the head of the pin 1. FIGS. 10*d* and 10*e* show the innermost part 24 of the bushing 10.

Figure 8A:
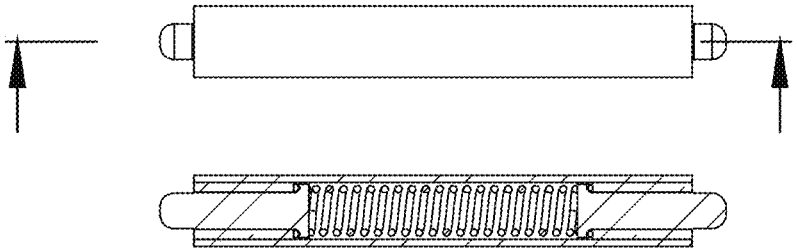
Figure 8B:
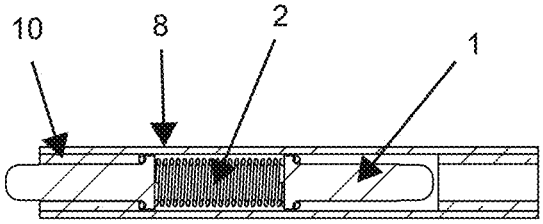
Figure 8C:
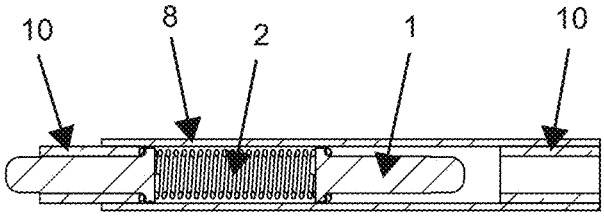
Figure 8D:
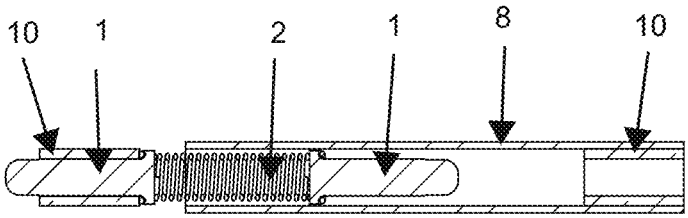

FIGS. 8*a-d* show another aspect of the invention, sequentially showing how the entire insides of the binding system can be pressed out for maintenance or replacement. The figures are shown in perspective and sectionalized. FIG. 8*a* shows the system in a use condition. If you wish to open the entire system, e.g. to inspect the inside and/or replace parts, one of the pins 1 can be pushed in until the spring 2 is entirely compressed, reference FIG. 8*b*. By continuing to push the pin 1 and now also the compressed spring 2, a substantial force can be applied to the opposite pin and bushing, keeping it in place. By applying sufficiently strong force, the opposite bushing will eventually be pressed out of the tube 8, reference FIGS. 8*c* and *d*. In FIG. 8*d*, all insides are released except for one bushing 10. This may then either just sit there, while the pins 1, spring 2 and gaskets 4 are inspected and are possibly replaced by spare parts or being repaired, or it can be taken out, e.g. by pushing it out from the inside by means of a suitable tool. Inspection may uncover a ruined, broken or slack spring, worn-out gaskets, worn slide faces between the pin 1 and the inside of the bushing 10, which could/should be replaced, possibly corrosion, stuck parts or the like that may be loosened, polished away, honed or released. Finally, the system can be reassembled in reverse order.

The invention claimed is:

1. A part of a ski binding system configured to be mounted in a front part of a shoe sole, comprising a housing with a barrel arranged in a direction transverse to a longitudinal axis of a ski with a fully or partially through-going bore coaxial with the barrel, where the barrel has an inner diameter, wherein two pins each moveable transverse to the longitudinal axis of the ski are arranged in the barrel with at least one intermediate spring element, and wherein the pins are adapted to slide in the barrel between a protruded position and a retracted position, characterized in that a first part of each pin is exposed when the pins are in the protruded position, and wherein a second part of each pin is adjacent to the first part of each pin and is unexposed when the pins are in the protruded position, wherein the first part of each pin has a reduced outer diameter compared with the inner diameter of the barrel and compared with the second part of each pin; wherein the reduced outer diameter of each pin is constant and constitutes an essentially straight bearing surface.

2. A part of a ski binding system according to claim 1, wherein a head end of the pin is rounded with a uniform radius of curvature.

3. A part of a ski binding system according to claim 1, wherein the pins comprise a base, wherein the base has a larger diameter than the inner diameter of the barrel.

4. A part of a ski binding system according to claim 3, wherein each pin is equipped with at least one gasket, which fully or partially seals the space between an outside circumferential surface of the pins and an inside circumferential surface of the barrel.

5. A part of a ski binding system according to claim 1, wherein the barrel through which the pins travel, consists of bushings that are pressed into the housing.

6. A part of a ski binding system according to claim 5, wherein each of the bushings is equipped with at least one grease storage in the form of a hole, an opening, a track or a recess.

7. A part of a ski binding system according to claim 6, wherein the at least one grease storage in the bushing is provided at a distance from an outer edge of the bushing.

8. A method for maintenance of a part of a ski binding system according to claim 6, characterized in that one of the pins is pushed past a retracted position of use such that a part of the pin, which has the reduced outer diameter, overlaps a part of the bushing comprising the grease storage, so that a gap is formed between the pin and the bushing, past which grease can be pressed and further into the grease storage.

9. A part of a ski binding system according to claim 5, wherein the bushing is grooved on an outer surface of the bushing.

10. A part of a ski binding system according to claim 5, wherein each pin is equipped with two gaskets, wherein the first gasket is adjacent to the base of the pin, wherein the second gasket is arranged in a radial, circular track in the pin, the second gasket being provided at a distance from an outer edge of the bushing.

11. A method for maintenance of a part of a ski binding system according to claim 5, characterized in that one of the pins is pushed past a retracted position of use such that a part of the pin, which has the reduced outer diameter, overlaps an innermost part of the bushing for a gap to be formed between the pin and the bushing, past which grease can be pressed.

12. A part of a ski binding system according to claim 1, wherein the housing comprises a closable opening, which provides access sideways to a part of the barrel.

13. A part of a ski binding system according to claim 12, wherein the size of the opening is sufficient for mounting and dismounting the pins and the at least one spring element.

14. A part of a ski binding system according to claim 12, wherein the opening is equipped with a cover.

15. A part of a ski binding system according to claim 1, wherein each pin is equipped with at least one gasket, which fully or partially seals the space between an outside circumferential surface of the pins and an inside circumferential surface of the barrel.

16. A method for maintenance of a part of a ski binding system according to claim 1, characterized in that one of the pins is pushed past a retracted position of use such that a part of the pin, which has the reduced outer diameter, overlaps an innermost part of the barrel for a gap to be formed between the pin and the barrel, past which grease can be pressed.

* * * * *